US006154891A

United States Patent [19]

Wilson

[11] Patent Number: 6,154,891

[45] Date of Patent: Dec. 5, 2000

[54] URINE TUBE

[76] Inventor: Evelyn E Wilson, 1341 W. 191st St., Homewood, Ill. 60403

[21] Appl. No.: 09/458,742

[22] Filed: Dec. 10, 1999

[51] Int. Cl.[7] ..... A47K 11/00

[52] U.S. Cl. ..... 4/144.4; 4/144.1; 141/331; 141/337

[58] Field of Search ..... 4/144.1, 144.2, 4/144.3, 144.4; 141/331, 337, 338, 339, 343; 441/40, 41, 42, 43, 48, 86, 108, 131

[56] References Cited

U.S. PATENT DOCUMENTS

| | | | |
|---|---|---|---|
| 268,555 | 12/1882 | Simpson . | |
| 676,836 | 6/1901 | Brown | 441/86 |
| 2,875,451 | 3/1959 | Stegeman | 4/144.4 |
| 3,222,701 | 12/1965 | Fest | 441/86 |
| 3,401,696 | 9/1968 | O'Brien | 141/331 |
| 3,477,074 | 11/1969 | Bezanis | 441/86 |
| 3,500,480 | 3/1970 | Michal . | |
| 3,579,652 | 5/1971 | Ericson | 141/337 |
| 3,976,076 | 8/1976 | Beach | 4/144.4 |
| 4,296,502 | 10/1981 | Bortle . | |
| 5,566,400 | 10/1996 | Jonec . | |
| 5,575,020 | 11/1996 | Hubrig . | |
| 5,605,161 | 2/1997 | Cross . | |

FOREIGN PATENT DOCUMENTS

| | | | |
|---|---|---|---|
| 549850 | 7/1993 | European Pat. Off. | 4/144.1 |
| 2936622 | 3/1981 | Germany | 4/144.1 |
| 555607 | 8/1993 | Germany | 4/144.2 |

*Primary Examiner*—Henry J. Recla
*Assistant Examiner*—Khoa D. Huynh
*Attorney, Agent, or Firm*—Don Moyer

[57] ABSTRACT

The urine tube has a neck which in use holds itself open and in stowage is flat, has an attachment fixture at the neck, has a sheath which is attached around the neck and which has an output end distal the neck, and has a weighted ring which holds the output end open and secures the output end in a receptacle.

1 Claim, 1 Drawing Sheet

URINE TUBE

BACKGROUND OF THE INVENTION

The invention is an elongated tube into which men can urinate while standing and have the tube direct the urine to a receptacle without splatter.

There is a long outstanding need for a device which will allow men—especially men with arthritis, conditions which cause shaking, and other similar problems—to urinate while standing without splatter. Various devices have been shown in prior art for example in U.S. Pat. No. 268,555 by Simpson, in U.S. Pat. No. 3,500,480 by Michal, in U.S. Pat. No. 4,296,502 by Bortle, in U.S. Pat. No. 5,566,400 by Jonec, in U.S. Pat. No. 5,575,020 by Hubrig, and in U.S. Pat. No. 5,605,161 by Cross. However none of these devices have solved the problem satisfactorily.

The problem is solved here by a urine tube which, in one form, has an attachment fixture which allows the tube to be secured in many ways, has an input neck which in use holds itself open and which in stowage is flat, and has a weighted ring which holds the output end open and keeps the output end within a receptacle. This solution is not suggested in any prior art or any combinations of prior art.

SUMMARY OF THE INVENTION

One form of the invention comprises a neck which in use holds itself open and in stowage is flat, a sheath attached around the neck, an output end of the sheath distal the neck, and an attachment fixture at the neck.

Other forms of the invention will be comprehended in the drawings and description, which will make additional forms obvious hereafter to persons skilled in the art.

DESCRIPTION OF THE PREFERRED EMBODIMENTS

Figure 1:
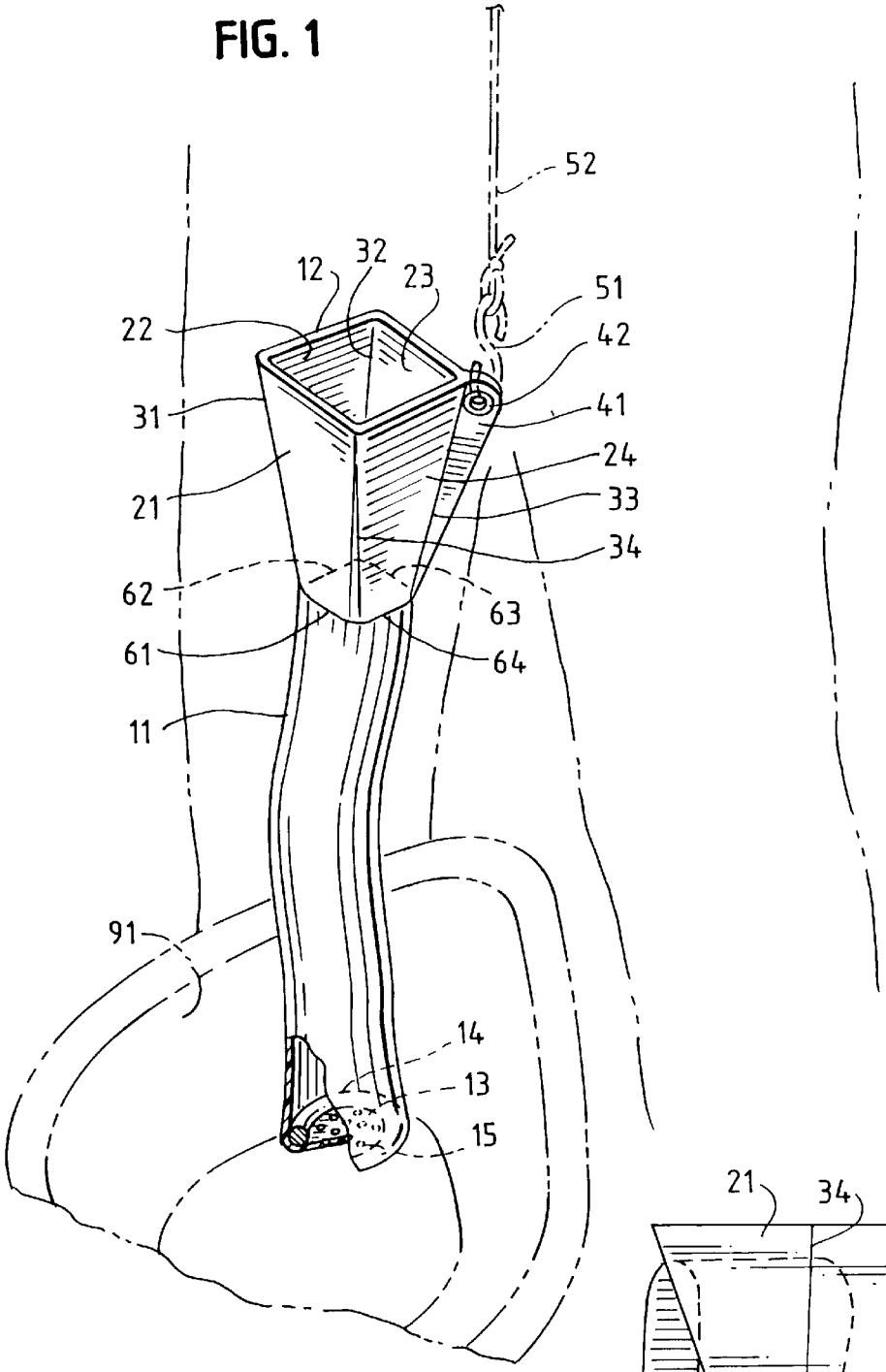
FIG. 1 shows the urine tube extended for use
Figure 2:
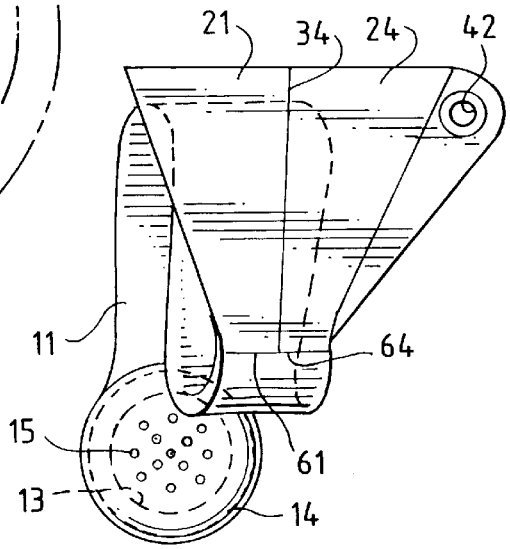
FIG. 2 shows the urine tube partly folded for stowage.

The urine tube comprises a neck 12, a flexible sheath 11 attached around the neck, an output end of the sheath 13 distal the neck, and an attachment fixture 42 at the neck. Preferably, the attachment fixture is an opening 42 through an ear 41 protruding away from the neck. In use elastic properties of the neck hold the neck open to receive urine as shown in FIG. 1. For stowage the neck is folded flat as indicated in FIG. 2.

In the preferred form a ring 14 is attached to the sheath at the output end 13. The ring holds the output end open and the weight of the ring holds the output end within a receptacle 91 such as a toilet bowl. The ring can also be made large enough to prevent the urine tube from being flushed down a toilet.

Preferably, the sheath is closed at the output end and has holes 15 through the output end smaller than the ring so that the ring is held inside the closed output end without any need for fixing the ring to the sheath. This also has the advantage that urine flowing from small holes splatters less than from free fall through an open-ended sheath.

It is important that the attachment fixture 42 be adapted to allow the urine tube to be attached by a wide range of means, because there is a wide range of receptacles and receptacle orientations with which the urine tube will be used. While several attachment fixtures known in the art might be used, the preferred attachment fixture is an opening which can be through the neck and can be through an ear protruding away from the neck.

The attachment fixture can be combined with a hook 51, such as an "S" hook, and a cord 52 to hang from many places where the cord can be secured. For example, the hook can hang from the top of a toilet, the cord can hang from, the top of a toilet, the cord can hang from a bracket above a receptacle, the cord can hang from a user's belt, and the cord can hang from the user's neck.

While several forms for the neck would allow it to hold itself open in use and allow it to be flat in stowage, the preferred form has a first wall 21, a second wall 22, a third wall 23, and a fourth wall 24, with the first wall being joined to the second wall at a first crease 31, the second wall being joined to the third wall at a second crease 32, the third wall being joined to the fourth wall at a third crease 33, and the fourth wall being joined to the first wall at a fourth crease 34. The sheath is attached to the first wall at 61, attached to the second wall at 62, attached to the third wall at 63, and attached to the fourth wall at 64. With this form, there are many materials which have elastic properties so that the neck will be held open by the elastic properties and so that the neck can be flattened for packing and stowage.

The urine tube is likely to be especially useful in hospital and similar settings. Preferably the urine tube is made of materials which are easily disposable through normal channels for disposing of similar waste materials.

Other equivalent forms for the neck, the attachment fixture, the sheath, and the ring and other equivalent connections among these elements will be obvious hereafter to persons skilled in the art. Therefore this invention is not limited to the particular examples shown and described here.

I claim:

1. A urine tube comprising:

a neck, in use the neck being held open elastically, in stowage the neck being flattened, the neck further comprising:
- a first wall;
- a second wall joined to the first wall at a first crease;
- a third wall joined to the second wall at a second crease;
- a fourth wall joined to the third wall at a third crease and joined to the first wall at a fourth crease;

an ear protruding from the neck;

an opening through the ear;

a sheath, the sheath being flexible, and the sheath being attached around the neck;

an output end terminating the sheath distal the neck; and a ring, the ring is disposed in the sheath at the output end, the output end being closed with a hole through the output end smaller than the ring.

* * * * *